US005844154A

United States Patent [19]

Kimble

[11] Patent Number: 5,844,154

[45] Date of Patent: Dec. 1, 1998

[54] COMBINATION ACOUSTIC AND ELECTRONIC PIANO IN WHICH THE ACOUSTIC ACTION IS DISABLED WHEN PLAYED IN THE ELECTRONIC MODE

[75] Inventor: Thomas E. Kimble, Cincinnati, Ohio

[73] Assignee: Baldwin Piano & Organ Company, Loveland, Ohio

[21] Appl. No.: 710,432

[22] Filed: Sep. 17, 1996

[51] Int. Cl.[6] ..... G10D 15/00

[52] U.S. Cl. ..... 84/171; 84/216; 84/219

[58] Field of Search ..... 84/171, 170, 216, 84/217, 219, 220

[56] References Cited

U.S. PATENT DOCUMENTS

| | | | |
|---|---|---|---|
| 2,250,065 | 7/1941 | Koehl . | |
| 4,633,753 | 1/1987 | Takahashi . | |
| 4,679,477 | 7/1987 | Monte . | |
| 4,682,526 | 7/1987 | Hall et al. . | |
| 4,704,931 | 11/1987 | Nagai et al. . | |
| 4,719,834 | 1/1988 | Hall et al. . | |
| 4,744,281 | 5/1988 | Isozaki . | |
| 4,970,928 | 11/1990 | Tamaki . | |
| 4,970,929 | 11/1990 | Ishida . | |
| 5,003,859 | 4/1991 | Monte et al. . | |
| 5,115,705 | 5/1992 | Monte et al. . | |
| 5,192,824 | 3/1993 | Shibukawa . | |
| 5,196,638 | 3/1993 | Hayashida et al. . | |
| 5,247,129 | 9/1993 | Nozaki et al. . | |
| 5,322,967 | 6/1994 | Matsuda . | |
| 5,374,775 | 12/1994 | Kawamura et al. . | |
| 5,386,083 | 1/1995 | Kawamura . | |
| 5,541,353 | 7/1996 | Kawamura et al. | 84/171 |
| 5,600,077 | 2/1997 | Hondo | 84/171 |
| 5,608,175 | 3/1997 | Kawamura | 84/171 |
| 5,652,403 | 7/1997 | Sugiyama et al. | 84/171 |

FOREIGN PATENT DOCUMENTS

| | | |
|---|---|---|
| 0573963A2 | 12/1993 | European Pat. Off. . |
| 3707591C1 | 5/1988 | Germany . |

*Primary Examiner*—Cassandra C. Spyrou
*Attorney, Agent, or Firm*—Frost & Jacobs LLP

[57] ABSTRACT

A combination acoustic mode and electronic mode grand piano is provided including a hammer shank stop rail that intercepts the hammer shank when operating in its electronic mode, so that the hammer cannot complete its normal travel to strike its corresponding string(s) when its key is actuated. The positioning of the hammer shank stop rail is actuated by a user-operated control that, when placed into the "acoustic" mode, raises the hammer shank stop rail to a non-engaged position that does not interfere with the normal movements of the hammer shank. When in the "electronic" mode, the control lowers the hammer shank stop rail into an engaged position where it intercepts the hammer shanks of the piano, thereby preventing each hammer head from striking its respective string(s). When in the engaged position, the wire cam also causes an "early escapement rail" to be moved into a location such that flexible "early escapement tabs" are moved into positions just beneath the letoff button of each of the key actions, thereby preventing a harsh "feel" or "touch" as perceived by the human player of the piano. In a second embodiment of a combination dual-mode piano, a hammer head stop rail is provided for an upright piano which intercepts the hammer head when in the electronic mode. When placed into the acoustic mode, the hammer head stop rail is rotated to a non-engaged position that is not within the normal path of the hammer travel. When operated in the electronic mode, the actuating arm is rotated such that the hammer head stop rail becomes positioned directly in the path of travel of the hammer heads of the upright piano, where they will impact directly against the stop rail. In the illustrated embodiment, the stop rail comprises a deflectable member that is coated with a sound and vibration absorbing material, such that when the hammer head impacts the stop rail, the deflectable member somewhat displaces, as the hammer head impacts against this member. The hammer head stop rail also includes a sound and vibration absorbing pad that is brought into position against the strings of the piano, thereby tending to dampen any acoustic vibration that may otherwise become induced in the strings.

16 Claims, 10 Drawing Sheets

COMBINATION ACOUSTIC AND ELECTRONIC PIANO IN WHICH THE ACOUSTIC ACTION IS DISABLED WHEN PLAYED IN THE ELECTRONIC MODE

TECHNICAL FIELD

The present invention relates generally to musical instruments and is particularly directed to pianos of the type which operate in both an acoustic mode and an electronic mode. The invention is specifically disclosed as a grand piano containing a standard acoustic piano key action along with an additional hammer shank stop rail that inhibits the striking of the strings by the hammer when the piano is played in its electronic mode. While in its electronic mode, the piano exhibits an early escapement feature in which the location of the letoff event is re-positioned so that the jack escapes from the hammer knuckle earlier in the hammer travel when the key is stuck, thus avoiding blocking of the hammer (and its adjacent jack) against the stop rail and thereby giving the keyboard essentially the same "feel" in the electronic mode as when it is played in its acoustic mode. A second embodiment also is provided in which the invention is disclosed as an upright piano containing a standard acoustic piano key action along with an additional hammer head stop rail that inhibits the striking of the strings by the hammer when the piano is played in its electronic mode.

BACKGROUND OF THE INVENTION

Acoustic pianos are very old in the art and have developed into musical instruments that use a rather standard key action. Generally speaking, a standard key action uses a key tail (the interior end of the key) to actuate a wippen, which then actuates a hammer shank through a jack and either a hammer butt or knuckle. The far end of the hammer shank is affixed to a hammer head that strikes the individual string(s) corresponding to the given musical tone for that key. The standard piano action also uses dampers to silence the string(s), until the damper is de-actuated by pressing its corresponding key or by pressing a pedal which simultaneously de-actuates all or one section of the dampers.

Electronic pianos are also old in the art, and conventional electronic pianos typically detect the movement of each of the individual keys by some type of sensor that generates an electrical signal. Some of these sensors are optical in nature, while others detect pressure or force induced against the key by a human user. Regardless of the exact method of detection of the key's movement, an electrical signal is produced when each of the keys is actuated, and in some conventional pianos, the velocity of the key's movement is additionally detected to vary the volume or some other characteristic of the tone to be produced by the sound engine of the electronic piano.

A relatively recent development is the combination of an acoustic piano and an electronic piano in which a single musical instrument can operate in two different modes: (1) an acoustic mode utilizing a standard piano action, and (2) an electronic mode utilizing a standard electric piano's components, however, also preventing the actuation of a portion of the acoustic piano's action, thereby inhibiting an acoustic tone from being generated. There are various types of conventional dual-mode pianos, some of which include the entire standard acoustic action of an upright piano, and others that only utilize a portion of a piano's action. For example, U.S. Pat. No. 4,679,477, by Monte, discloses a "silent" electronic keyboard that includes a pivoted "silent hammer," which has its momentum stopped by a "stop rail."

The hammer is directly engaged by the key tail of the keys using a cam and follower action.

Another patent, by Nagai (U.S. Pat. No. 4,704,931), inhibits the vibration of the strings of a piano when operated in its "silent mode." A damper is placed against each of the strings so that when the hammer strikes the string, there will be little or no vibration. During normal acoustic playing mode, the damper is pivoted away from the strings, thereby allowing acoustic tones to be generated in the normal fashion.

An upright piano that includes a hammer-stopping mechanism that suppresses acoustic piano sounds is disclosed in Seiler (DE 37 07 591 C1). This hammer-stopping mechanism is referred to in Seiler as a "register rod" and has no effect on the normal operation of the acoustic action when the piano is operating in its acoustic mode. However, when the piano is operated in its "synthesizer" mode, this register rod intercepts the movement of the hammer shank so that the tip of the hammer cannot strike its corresponding string. The register rod is pivotable about a 90° angle between its actuated and non-actuated positions. As related above, in its non-actuated position, the register rod does not interfere with the hammer shank so that the hammer may strike the string when its corresponding key is operated. To actuate the register rod, one of its sides is pulled down or to the side so that the register rod pivots about a 90° angle such that its intercepting surface is placed in a position that will interfere with the movement of the hammer shank when its corresponding key is operated. By so interfering, the hammer shank is intercepted before it can complete its normal full travel, thereby preventing the hammer from completing its full travel and striking the string.

Another combination acoustic and electronic piano is disclosed in Yamaha (EP 0 573 963 A2), which includes a "stopper" that contacts the hammer shank before its corresponding hammer can strike the string. Yamaha discloses a "mechanical sound producing mode" (i.e., an acoustic mode) and an "electronic sound producing mode" (i.e., an electronic mode). The stopper is actuated between a "free position" and a "blocking position," in which the free position does not interfere with the normal operation of the key action so that the hammer may strike its corresponding string. In the blocking position, the stopper will contact the hammer shank before the shank reaches its normal end travel, thereby also preventing the hammer from reaching its end travel so that its corresponding string is not contacted by the tip of the hammer.

The stopper is mainly constructed of a rotatable shaft that is usually actuated manually, or it can be actuated by a motor. The shaft includes three lobes that protrude from one side of the shaft, much like a cam. At the farthest tip of these lobes is a cushion that is designed to contact the hammer shank without unduly creating noise. When the stopper is in its "free position," the lobes are pointed in an upward, vertical direction so as to not interfere with the movement of the hammer shank as it approaches from the side. When in the "blocking position," the lobes, having been rotated 90° from the vertical to the horizontal, now intercept the hammer shank so that it cannot complete its normal travel. Each of the three lobes is designed to intercept the hammer shanks of one of the three portions of the piano keys, i.e., the bass, tenor (mid-range), and treble keys, which would correspond to the three different sections of the piano action.

Another combination acoustic and electronic piano is disclosed in Kawamura (U.S. Pat. No. 5,386,083) in which the hammer shank is extended beyond its normal length past the hammer head, and a moveable hammer stopper is used to intercept his extended portion of the hammer shank. In the normal "acoustic" mode, the hammer stopper is pivoted into a position that will not intercept the hammer shank, thereby allowing the hammer head to follow through its normal travel and strike its associated string. In the blocking position, the hammer stopper pivots directly into the arcuate path of the extended portion of the hammer shank, and when the associated key is struck by a human user, the hammer head will attempt to strike the string, however, the hammer stopper blocks the movement of the extended hammer shank before the shank reaches its normal end travel, thereby preventing the hammer from reaching its end travel to strike its corresponding string.

The conventional hammer shank stopping mechanisms are not suitable for all configurations of pianos, particularly where the space requirements or connectivity requirements of a particular piano cannot be made compatible.

SUMMARY OF THE INVENTION

Accordingly, it is a primary object of the present invention to provide a combination acoustic mode and electronic mode grand piano that utilizes a hammer shank stop rail to prevent the hammer from striking the string of a key action when used in the electronic mode while preserving the "touch" or "feel" of an acoustic piano, yet allowing the hammer action to operate normally when operated in the acoustic mode, in which the hammer shank stop rail actuates a wire cam, in which the stop rail is operated by an actuator controlled by the human user.

It is another object of the present invention to provide a combination acoustic mode and electronic mode grand piano that utilizes a hammer shank stop rail to prevent the hammer from striking the string of a key action when used in the electronic mode while preserving the "touch" or "feel" of an acoustic piano, yet allowing the hammer action to operate normally when operated in the acoustic mode, in which an "early escapement" or "early letoff" mechanism is provided that prevents portions of the key action from interfering with one another during the electronic mode, thereby preventing a harsh "feel" and incomplete key travel to the keyboard action as perceived by the human performer.

It is another object of the present invention to provide a combination acoustic mode and electronic mode grand piano that utilizes a hammer shank stop rail to prevent the hammer from striking the string of a key action when used in the electronic mode while preserving the "touch" or "feel" of an acoustic piano, yet allowing the hammer action to operate normally when operated in the acoustic mode, in which an early escapement rail is provided having a flexible early escapement tab that, during the electronic mode, is interposed between the jack and the letoff button, thereby re-positioning the location of the letoff event to a sufficient degree so that the opposite end of the jack escapes contact with the hammer knuckle earlier in the hammer's travel when the whippen is raised by the piano's key tail, thereby preserving the "touch" or "feel" of an acoustic piano.

It is a further object of the present invention to provide a combination acoustic mode and electronic mode upright piano that utilizes a hammer head stop rail to prevent the hammer from striking the string of a key action when used in the electronic mode while preserving the "touch" or "feel" of an acoustic piano, yet allowing the hammer action to operate normally when operated in the acoustic mode, in which the hammer head stop rail is pivotally actuated from a non-engaged position to an engaged position, and once in the engaged position, the stop rail directly absorbs the impact of each hammer head of the upright piano.

It is a yet further object of the present invention to provide a combination acoustic mode and electronic mode upright piano that utilizes a hammer head stop rail to prevent the hammer from striking the string of a key action when used in the electronic mode while preserving the "touch" or "feel" of an acoustic piano, yet allowing the hammer action to operate normally when operated in the acoustic mode, in which the hammer head stop rail, once in its engaged position, provides a pad of sound-absorbing and vibration-absorbing material to be placed against the strings of the piano, thereby helping to dampen any vibration in those strings, while at the same time providing a deflectable member of the stop rail that directly absorbs the impact of the hammer heads of the piano.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved combination acoustic mode and electronic mode grand piano is provided including a hammer shank stop rail that intercepts the hammer shank when operating in its electronic mode, so that the hammer cannot complete its normal travel to strike its corresponding string(s) when its key is actuated. The hammer shank stop rail is pivotally operated by a rotatable member that is actuated by a human user. When placed into the "acoustic mode," the rotatable member raises the hammer shank stop rail to a "non-engaged position" that does not interfere with the normal movements of the hammer shank, thereby allowing the hammer to strike its corresponding string(s). When in the "electronic mode," the rotatable member lowers the hammer shank stop rail into an "engaged position" where it intercepts the hammer shanks of the piano, thereby preventing the hammer head from striking its respective string(s).

When in the non-engaged position, a wire cam is raised, via a spring, to a position substantially contacting the bottom surface of the hammer shank stop rail, which causes an "early escapement rail" to be positioned away from the letoff buttons, thereby not interfering with the normal operation of the jacks against their particular letoff buttons, and allowing a "normal" escapement between the other end of the jacks and their associated knuckles. When in the engaged position, however, the wire cam causes the early escapement rail to be moved into a location such that flexible "early escapement tabs" are moved into positions just beneath the letoff button of each of the key actions, and when the jack is operated for a particular key action (by movement of the key tail and whippen), the jack's orientation with the letoff buttons will be somewhat re-positioned so that the opposite end of the jack essentially performs an early letoff or release from contact with its associated hammer knuckle. By virtue of this re-positioning, the position of the "escape event" between each jack/knuckle combination occurs at a point earlier in the travel of the hammer, thereby preventing a harsh "feel" or "touch" as perceived by the human player of the piano.

If not for the early escapement tabs, the jack would continue to contact the hammer knuckle further into the travel of the hammer (i.e., as per its "normal" movements in the acoustic mode of operation), and the contact of the stop rail against the hammer shank would occur while the knuckle is still in contact with the jack, thereby causing the movement of the jack to be prematurely stopped short of its normal travel, which would mechanically feed back a harsh "feel" via the whippen, capstan screw, and key tail, to the human player's finger. The early escapement tabs cause a slight angular re-positioning of the jack so that, as the key tail and whippen are raised in elevation, the end of the jack (being angularly re-positioned) will "escape" from the hammer knuckle at a lower elevation (i.e., earlier in the travel of the hammer), and thereby not changing the "feel" or "touch" of the key.

As an optional feature, the combination acoustic mode and electronic mode piano can be simultaneously operated in both its acoustic and electronic modes, in which the piano's strings are being mechanically actuated by the piano action and the electronic piano features are also operating to provide an electrical signal output that can be communicated to a speaker or to a MIDI sound module. The normal pedal movement is not used in this circumstance, and the electronic output is turned ON by a separate switch. As a further optional feature, the stopping mechanism could be utilized as a practice feature without any electronics.

In a second embodiment of a combination dual-mode piano, a hammer head stop rail is provided for an upright piano which intercepts the hammer head when in the electronic mode, so that the hammer cannot complete its normal travel and strike its corresponding string(s) when its key is actuated. The hammer head stop rail is mounted on a pivotable arm that receives rotational motion from an actuator that is operated by the human player of the piano. When placed into the acoustic mode, the hammer head stop rail is rotated to a non-engaged position that is not within the normal path of the hammer travel, thereby allowing the hammer head to contact its corresponding string(s) when actuated by its corresponding key. When operated in the electronic mode, the actuating arm is rotated such that the hammer head stop rail becomes positioned directly in the path of travel of the hammer heads of the upright piano, and the hammer heads will impact directly against the stop rail assembly. In the illustrated embodiment, the stop rail comprises a deflectable member that is coated with a sound and vibration absorbing material, such that when the hammer head impacts the stop rail, the deflectable member somewhat displaces, as the hammer head impacts against this deflectable member. In view of the vibration and sound absorbing material, the mechanical noise created by the hammer heads impacting against the deflectable member of the stop rail is quite minimal. Furthermore, in the illustrated embodiment the hammer head stop rail includes a sound and vibration absorbing pad that is brought into position against the strings of the piano, thereby tending to dampen any acoustic vibration that may otherwise become induced in the strings. In this construction, the impact of the hammer head against the deflectable member of the hammer head stop rail actually serves to help silence any vibration of the strings. The same (as related above) operational feature of simultaneous operation in both acoustic and electronic modes can be accomplished in the second embodiment.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
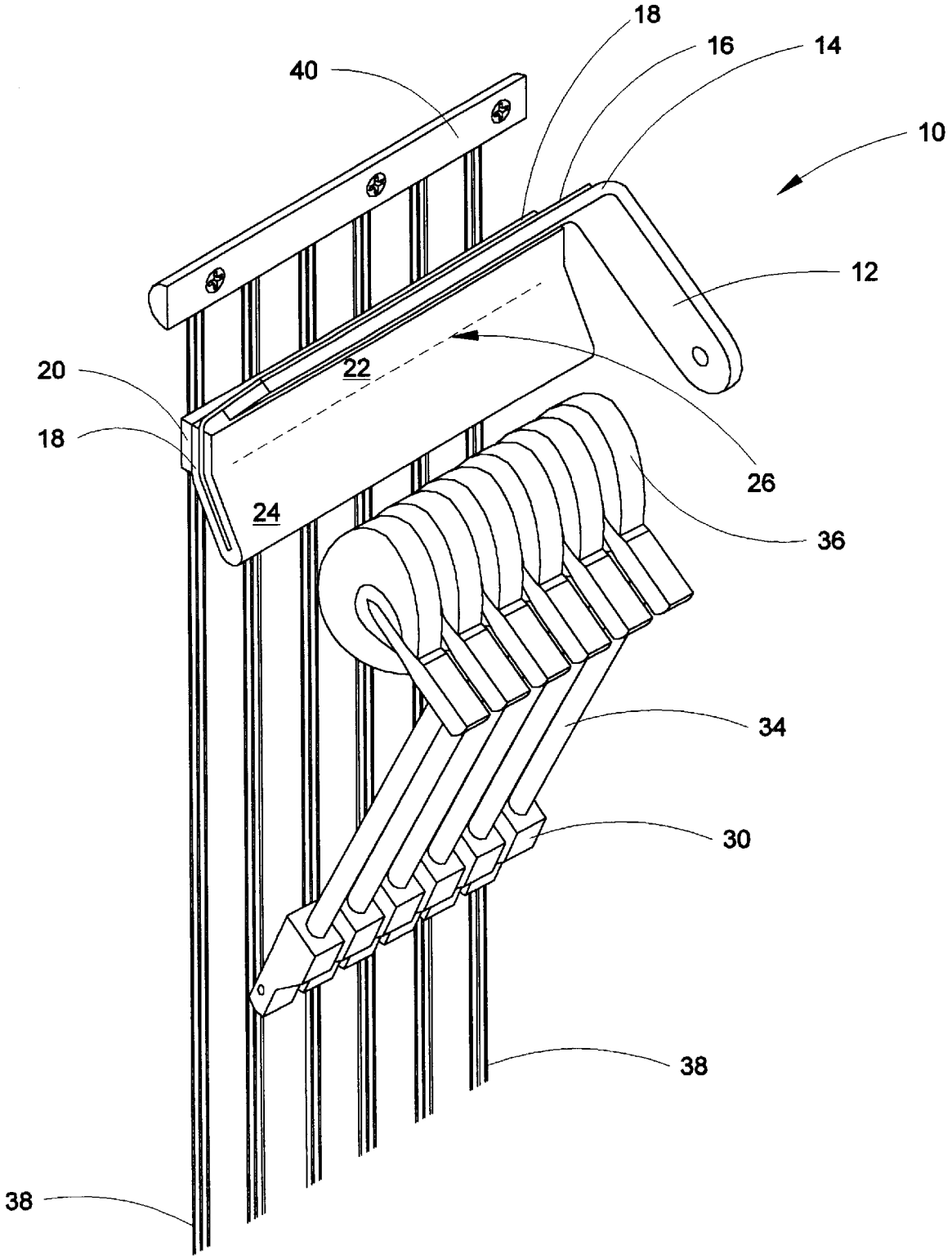
FIG. 1 is a perspective view of a hammer head stop rail system used in a combination dual-mode upright piano that can operate in either an acoustic mode or an electronic mode, and constructed according to the principles of the present invention.

Referring now to the drawings, FIG. 1 shows a portion of the key action for an upright piano in which a hammer head stop rail, generally designated by the index numeral 10, it is located between the hammer heads 36 and the strings 38. The upper portions of the key action for several keys are shown in FIG. 1, including the individual hammer heads 36, hammer shanks 34, and hammer butts 30. The strings 38 are held in place by a string termination bar 40.

Figure 2:
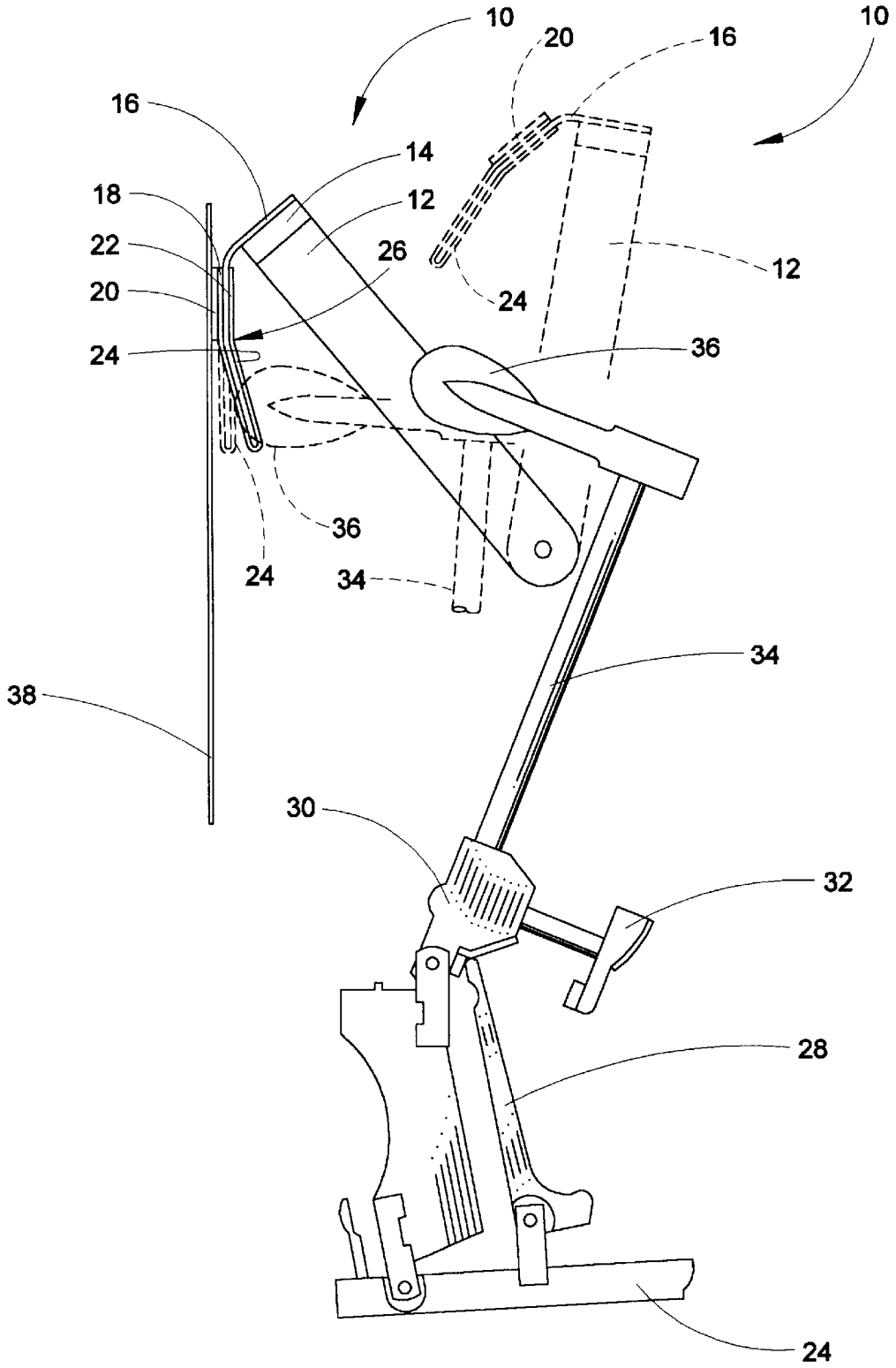
FIG. 2 is a side elevational view in partial cross-section of the hammer head stop rail of FIG. 1, depicted in both its actuated or "electronic mode" position and its non-actuated or "acoustic mode" position.

The hammer shank stop rail assembly 10 includes a rotatable actuator arm 12, which extends and bends at a 90 degree angle to become a longitudinally-extended rail 14. Attached to the rail is a deflectable member 16 having two fold lines to create a relatively open "U"-shape (as seen from the side of the piano), preferably constructed of hard aluminum sheet 0.010 inches thick. This relatively thin aluminum sheet will be somewhat deflectable at the fold line designated by the index numeral 26 when hammer heads 36 strike the impact area 24 of this member. As can be best seen on FIG. 2, member 16 will be flexed somewhat by the impact of a hammer head 36, as shown in FIG. 2 in dashed lines. Deflectable member 16 could also be made of a plastic material such as extruded PVC.

Much of the surface of member 16 is covered by a sound absorbent and vibration absorbent material, preferably felt, at areas designated by the index numerals 18, 22, and 24. This felt layer will tend to absorb any acoustic noise induced by the impact between the hammer head 36 and the impact area 24 of member 16. Another pad of sound absorbent and vibration absorbent material, designated by the index numeral 20, is attached to the "string" side of member 16, and this pad too is preferably made of felt. When the hammer head stop rail assembly 10 is in its engaged position, such as seen in FIG. 1 and in solid lines in FIG. 2, this "thicker" felt pad 20 will contact against the strings 38. This felt pad 20 preferably is thicker than the other pad (at 18) to compensate for strings that may not be in the exact same plane as most other strings. When the hammer heads 36 impact against the impact area 24 of member 16, felt pad 20 will tend to dampen any acoustic vibrations that may otherwise be induced in strings 38.

In FIG. 2, further portions of the key actions can be viewed, such as the butt heel 32, the jack 28, and the whippen 24. The hammer head stop rail assembly 10 is viewed in its two operating positions, its non-engaged position, shown in phantom lines, and its engaged "blocking" position, shown in solid lines. The rotatable arm 12 can be seen to pivot about a point where an actuating device (not shown) would preferably be located. The member 16 with its impact area 24 can be seen (in phantom lines) to be outside the path of travel of the hammer head 36 in the nonengaged position. The same components, as seen in solid lines, can be seen to be located so as to block the final travel of the hammer head 36 when the member 16 is in the engaged, blocking position. As related above, the impact area 24 portion or member of the member 16 can deflect at its fold line 26 when impacted by hammer head 36 (as seen in dashed lines on FIG. 2).

Figure 3:
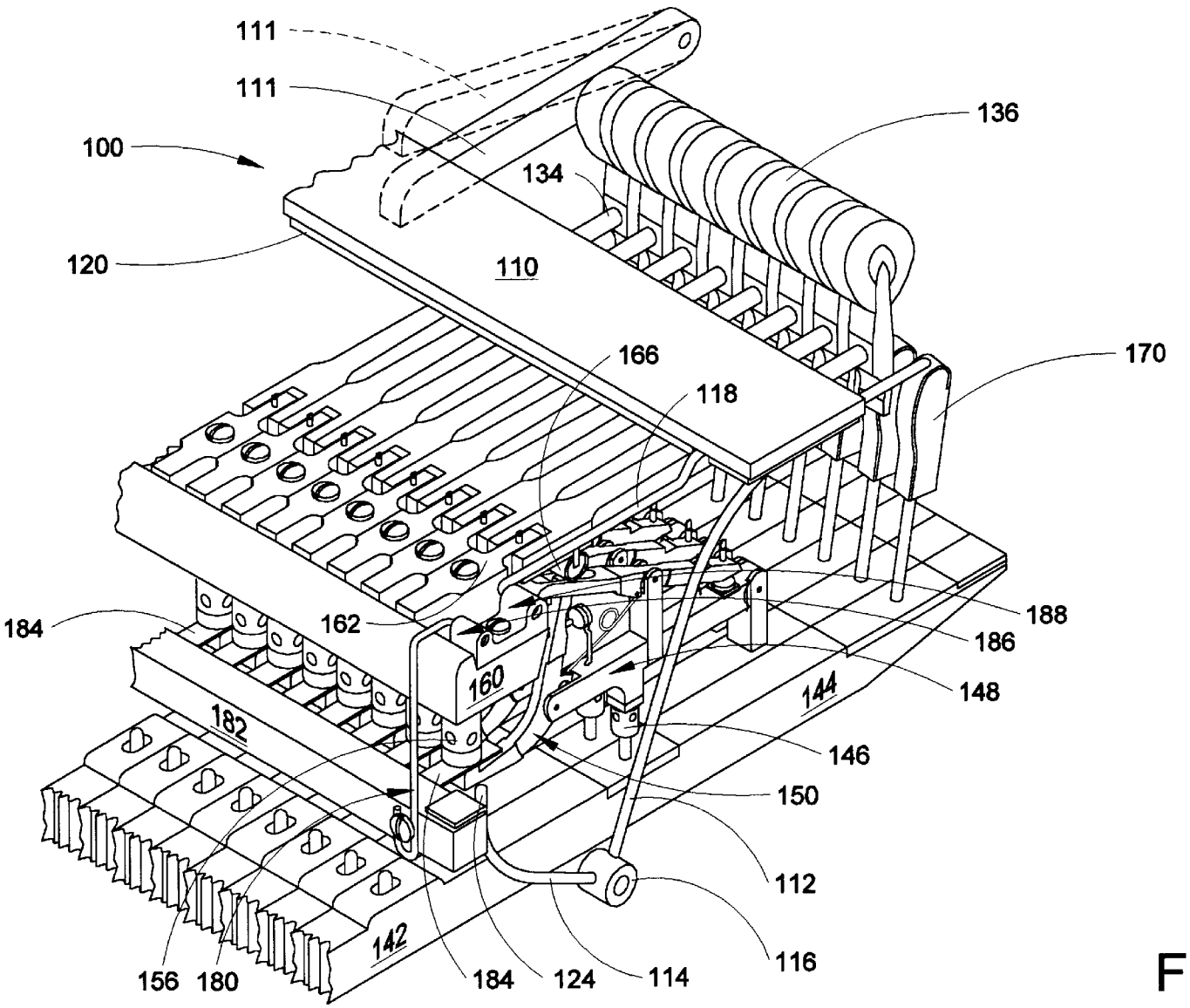
FIG. 3 is a perspective view of a hammer shank stop rail system used in a combination dual-mode grand piano that can operate in either an acoustic mode or an electronic mode, and constructed according to the principles of the present invention, as depicted in its engaged or "electronic mode" position.

FIG. 3 shows a portion of a grand piano key action along with a hammer shank stop rail assembly, generally designated by the index numeral 100. Many of the conventional components of a grand piano key action are depicted in FIG. 3, starting with keys designated by the index numeral 142 and associated key tails at index numeral 144. Each key tail 144 actuates a whippen 148 via a capstan screw 146. When actuated, whippen 148 actuates a jack 150, which in turn contacts a stationary letoff button 156 (at one end of the jack at its surface 152—see FIG. 4) and a hammer knuckle 166 at the opposite end of the jack (at surface 154—see FIG. 4).

Figure 4:
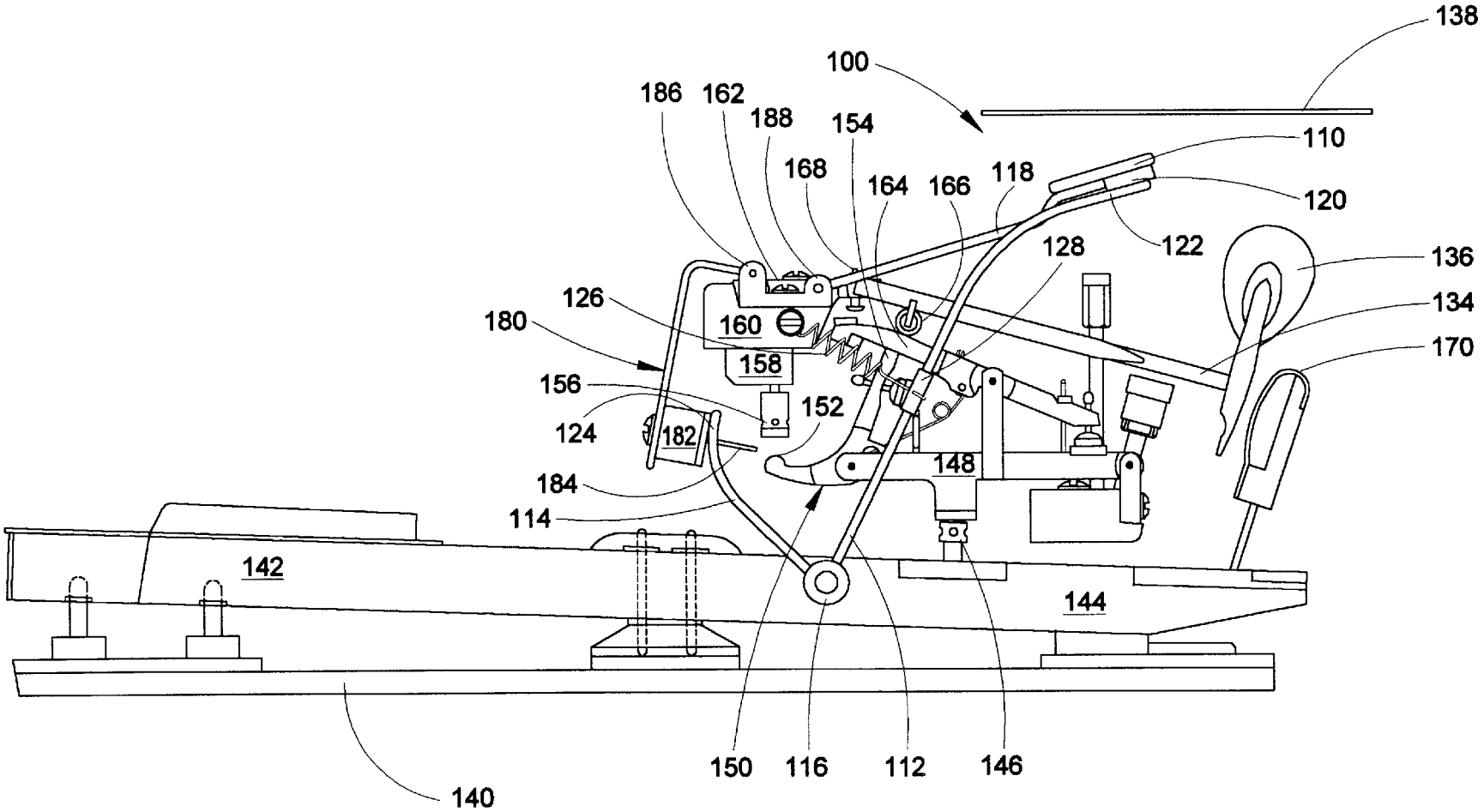
FIG. 4 is a side elevational view in partial cross-section of the grand piano hammer shank stop rail of FIG. 3, depicted in its non-actuated or "acoustic mode" position, while the hammer head is in its lower or non-striking position.

Other components of a conventional grand piano key action depicted in FIG. 3 include a main action rail 160, a series of hammer flanges 162, and a series of hammer shanks 134 and associated hammer heads 136. In addition, several backchecks 170 are shown, as well as numerous repetition levers 164 (see FIG. 4). Also viewed in FIG. 4 are a piano key bed 140, a letoff rail 158, hammer screws 168, and piano strings 138.

Most of the major components of the hammer shank stop rail assembly 100 are depicted in FIG. 3. The main longitudinal stop rail is designated at index numeral 110, and is shown in its engaged or "blocking" position. On the bottom surface of stop rail 110 is a sound absorbing and vibration absorbing pad 120, which preferably is made of felt. Stop rail 110 is affixed to the movable end of a positioning arm 118, which pivots about a point in a positioning block, designated by the index numeral 188.

Figure 6:
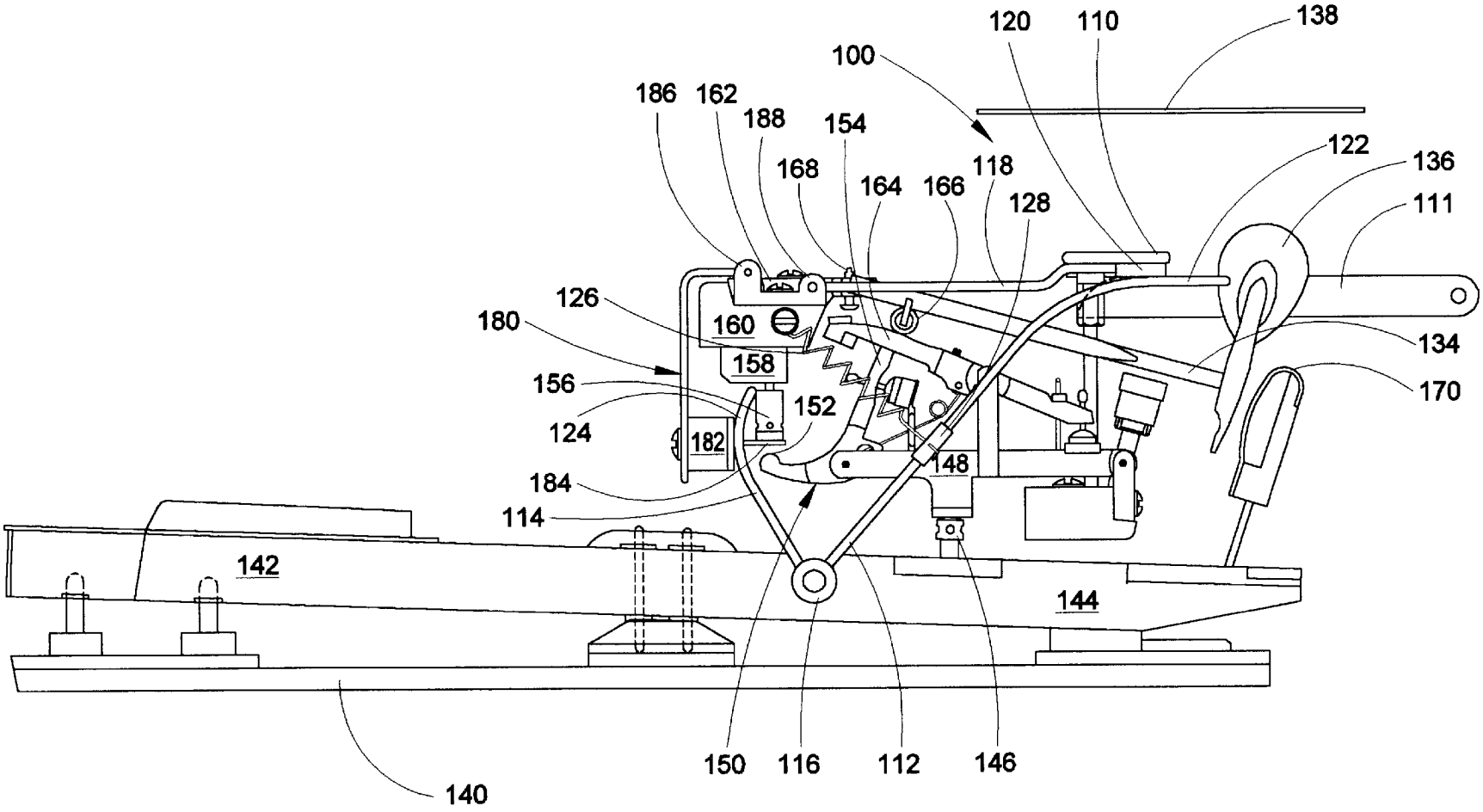
FIG. 6 is a side elevational view in partial cross-section of the grand piano hammer shank stop rail of FIG. 3, depicted in its engaged or "electronic mode" position, while the hammer head is in its lower or non-striking position.

Stop rail 110 is actuated by a pivotable actuator 111 (see FIG. 3) which either raises stop rail 110 to its non-engaged (i.e., "acoustic mode") position, or lowers stop rail 110 to its engaged (i.e., "electronic mode") position. Actuator 111 is movable about one end which raises the hammer shank stop rail assembly 100 when in its non-engaged position, such as the stop rail's position as seen in FIG. 4. Actuator 111 also can pivot to lower the hammer shank stop rail assembly 100 when in its engaged position, as depicted in FIGS. 6 and 3. Actuator 111 preferably is actuated by a rotatable shaft or other movable device (not shown) that, in turn, can be controlled by the human performer of the piano. Such an actuator device can be easily connected to a foot pedal mechanism (not shown) or an actuating knob mechanism (not shown).

A movable wire cam, generally designated by the index numeral 112, rotates about a pivotable hub 116. Wire cam 112 is movable about one end 122 that raises, due to a coil spring 126, along with the hammer shank stop rail assembly 100 when in its non-engaged position (as seen in FIG. 4). In this position, the wire cam's end 122 presses against the bottom surface of sound absorbing and vibration absorbing pad 120. Spring 126 is attached between the main action rail 160 and a location 128 along the length of wire cam 112. While spring 126 raises wire cam 112 to this non-engaged position, spring 126 is not strong enough to overcome gravity, thereby not preventing the hammer shank stop rail assembly 100 from being lowered into its engaged or blocking "electronic mode" position (as seen in FIG. 6) at times when actuator 111 is lowered.

Hub 116 is also attached to another wire cam, generally designated by the index numeral 114. This second wire cam 114 controls the positioning of an "early escapement rail," designated by the index numeral 182, via the movable end 124 of wire cam 114. Early escapement rail 182 pivots about a point in the positioning block at index numeral 186, via a second positioning arm 180. Protruding from the early escapement rail 182 are numerous flexible "early escapement tabs," designated by the index numeral 184. In the illustrated embodiment, there is an individual early escapement tab 184 for each individual key 142 of the piano. It will be understood that the illustrated early escapement tabs could also be easily constructed of a single continuous rectangular piece of flexible material without departing from the principles of the present invention. One reason to use individual tabs is to prevent mechanical cross-talk between jacks 150 of individual key actions.

Figure 5:
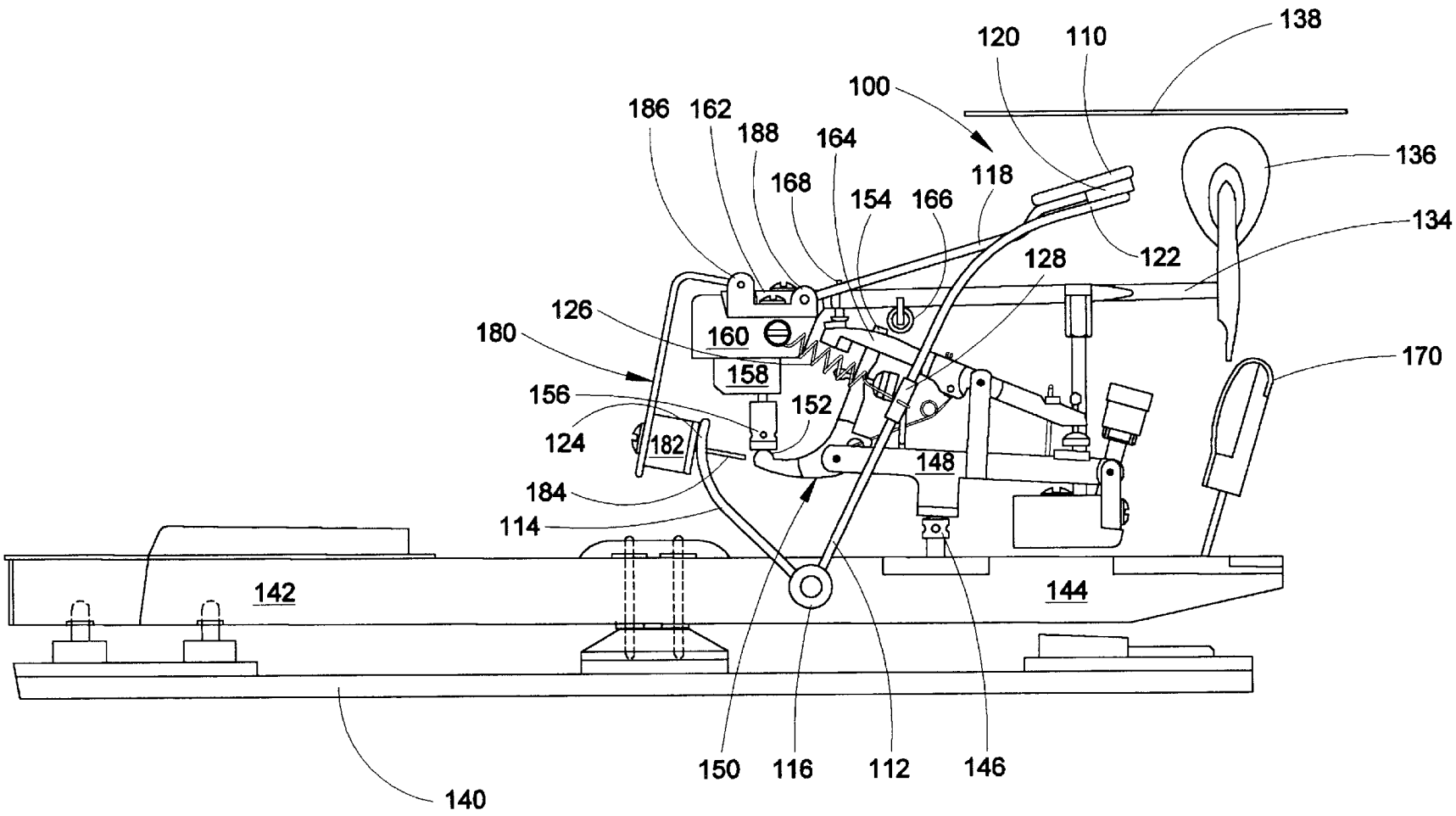
FIG. 5 is a side elevational view in partial cross-section of the grand piano hammer shank stop rail of FIG. 3, depicted in its non-actuated or "acoustic mode" position, while the hammer head is in its upper or string-striking position.

In FIG. 4, hammer shank stop rail assembly 100 is in its upper, non-engaged "free" position, where it will not interfere with the normal of the hammer shanks 134 (as can be seen in FIG. 5). The pivotable hub 116 has been rotated counterclockwise, via spring 126, and wire cam 112 remains in contact against the bottom surface of the sound absorbing pad 120 at times when hammer shank stop rail assembly 100 has been raised by actuator 111. At the same time, the rotation of hub 116 causes the second wire cam 114 to push the early escapement rail 182 away from the letoff button 156 and surface 152 of jack 150.

FIG. 5 also illustrates the hammer shank stop rail assembly 100 in its non-engaged portion, and further illustrates the fact that the hammer shanks 134 are not intercepted by stop rail assembly 100, thereby allowing their associated hammer heads 136 to contact their associated string(s) 138. In FIG. 5, it can be seen that the end 154 of jack 150 is still in contact with the hammer knuckle 166, thereby raising the hammer shank 134. In this position, end 154 of jack 150 will "escape" from contact with knuckle 166 as jack 150 is further raised by whippen 148, due to the contact between the letoff button 156 and the other end 152 of the jack. In other words, the positioning of the components depicted in FIG. 5 shows the approximate location of the "letoff event," meaning that the end 154 of jack 150 has been in contact with the knuckle 166 throughout the entire travel (or stroke) of hammer shank 134 up to this location in that travel, and in the next instant, the further upward movement of whippen 148 will attempt to further raise the end 154 of jack 150 against knuckle 166. Instead, however, the end 154 of the jack de-couples from the knuckle 166 (i.e., it "escapes" from further contact therewith), and the hammer shank 134 and its associated hammer head 136 will tend to stop moving upward. Of course, if the key tail 144 has been vigorously actuated by the human performer, then the shank 134 and head 136 will contain enough momentum to continue moving further up until head 136 contacts the string 138. Generally speaking, the location of the letoff event will occur at the same point in the travel of the hammer regardless of the velocity imparted into whippen 148 by key tail 144.

The opposite end of jack 150, at surface 152, is making contact with letoff button 156 in FIG. 5, which causes (by "cam" action of the curved surface 152 against the bottom of the stationary letoff button 156) the jack to pivot a certain amount about its pivotal connection with the whippen 148. This pivotal movement causes the other end 154 of jack 150 to be forced somewhat to the "side" of knuckle 166, and eventually escape entirely from any contact with knuckle 166. The general purpose of this escapement is to disengage the end 154 of jack 150 from the hammer knuckle 166 before the hammer head 136 strikes string 138. If this fails to occur, the mechanical feedback causing a particular "touch" or "feel" of this key action can be easily discerned by the human performer who is striking the key 142. This concept will be discussed in more detail below.

FIG. 6 shows the hammer shank shop rail assembly 100 in its engaged or "blocking" position, in which hub 116 has been rotated clockwise as compared to its position as illustrated in FIGS. 4 and 5. The spring 126 has been forced to extend somewhat, thereby putting a certain amount of tension on wire cam 112, however, as related above, spring 126 is not strong enough to prevent wire cam 112 and stop rail assembly 100 from being lowered by the shaft actuator 111, which is operating the stop rail assembly 100. In FIG. 6, the hammer shank 134 is not contacting stop rail assembly 100 since the key 142 has not been actuated by the human performer, and the hammer shank 134 is in its lower-most position.

Since hub 116 has been rotated clockwise, the early escapement rail 182 has also been moved (via sliding cam action down the curved surface of wire cam 114 near end 124) into its engaged portion, in which the early escapement tabs 184 are brought into contact against the bottom surface of letoff buttons 156. While the early escapement tabs 184 have been described herein as being "flexible," it is important to note that these tabs also must exhibit a certain amount of stiffness so that they remain in place against the bottom surface of the letoff buttons 156. In the preferred embodiment, the tabs are made of polyethylene having a thickness of 0.045 inches. Such material is available having the necessary thickness, flexibility, and stiffness characteristics in the form of cable ties such as used to bundle electrical wires and cables.

Figure 7:
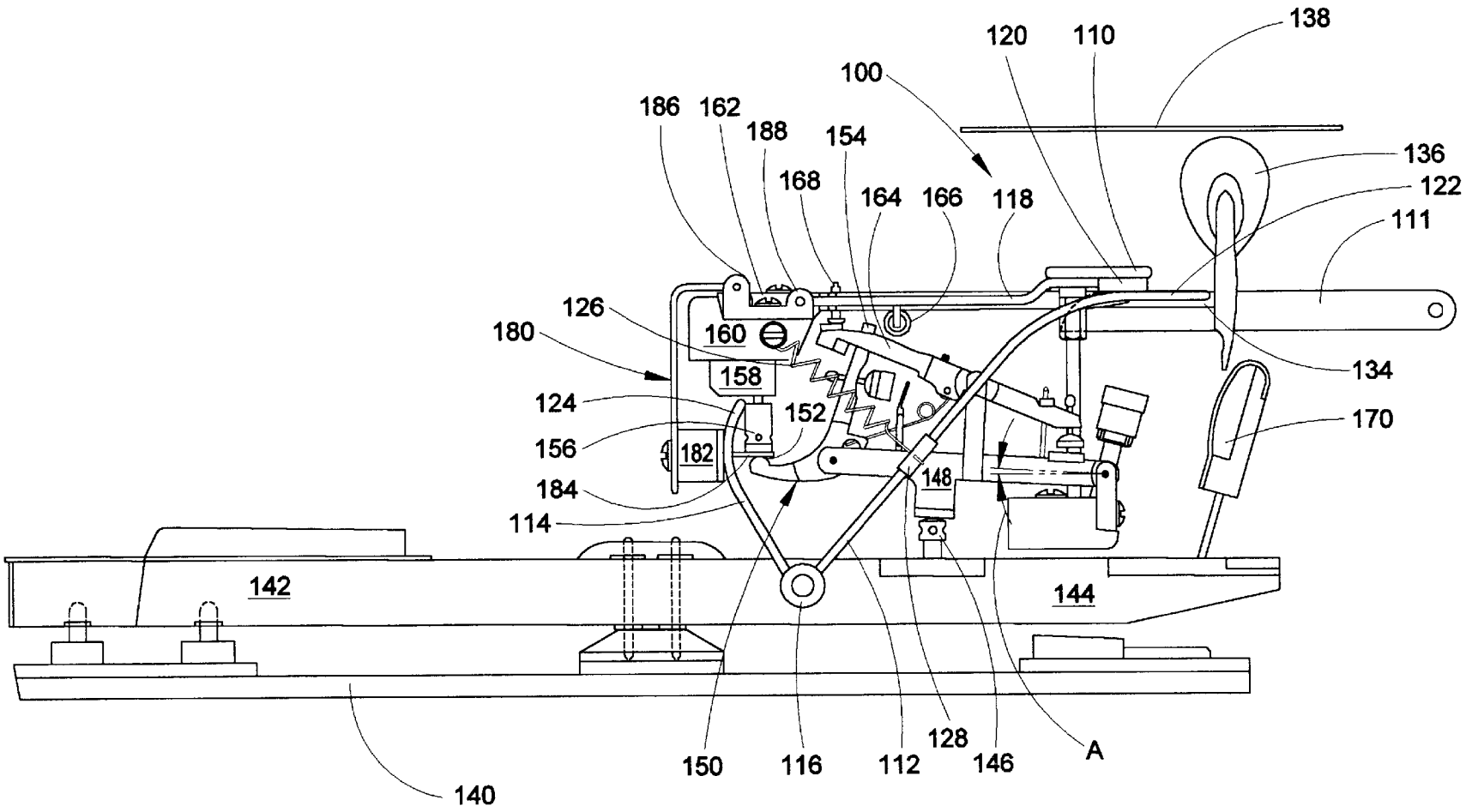
FIG. 7 is a side elevational view in partial cross-section of the grand piano hammer shank stop rail of FIG. 3, depicted in its engaged or "electronic mode" position, while the hammer head is in its uppermost position where the hammer head attempts to strike the string, but is intercepted by the by the hammer shank stop rail before being able to make contact with the string.

In FIG. 7, the illustrated key 142 has been actuated, thereby forcing hammer shank 134 against the pad 120 of the hammer shank stop rail assembly 100. When this occurs, the hammer head 136 is not permitted its fall travel, and is thereby prevented from striking the string 138. The purpose of the early escapement tabs 184 is illustrated in FIG. 7. Because of the thickness of tab 184, the jack 150 has its lower, left end surface 152 forced somewhat downward (as viewed in FIG. 7), which rotates the jack 150 in the counterclockwise direction about its pivot point (where it connects to the whippen 148). This causes the position of the opposite end 154 of jack 150 to be rotated a small distance away from the hammer knuckle 166, which allows the hammer shanks 134 to impact against the pads 120 without any mechanical restriction or feedback that would also prematurely inhibit the motions of the jacks 150, whippen 148, and keytail 144. Such premature restricted motion would be easily discerned by the human performer touching the keys 142.

Figure 10:
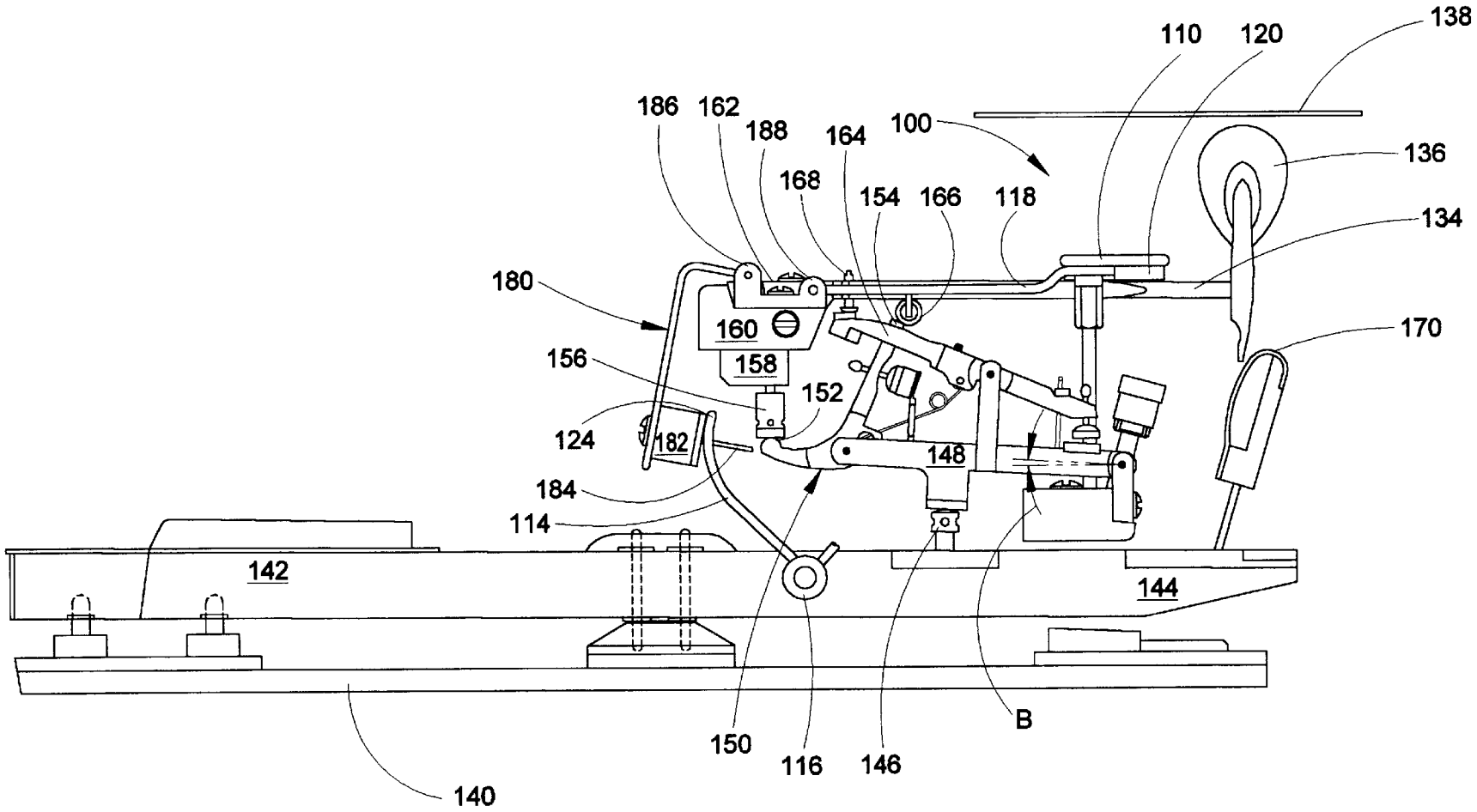
FIG. 10 is a side elevational view in partial cross-section of the grand piano hammer shank stop rail of FIG. 3, showing a hypothetical view in which the hammer shank stop rail is located in its engaged position, however, the "early escapement rail" is out of position, thereby not allowing an early letoff of the jack's movement, thereby illustrating the situation where the "feel" or "touch" of the key action is blocked by the end of the jack coming into contact with the hammer knuckle.

The differences between the arrangement of FIG. 7 and a hypothetical configuration shown on FIG. 10, where the early escapement tabs 184 are not in position, can be viewed by directly comparing FIGS. 7 and 10. In FIG. 7, the angle of the centerline of whippen 148 with respect to the horizontal in designated by the letter "A". In FIG. 10, this same angle is designated by the letter "B".

In FIG. 10, the end cam surface 152 of jack 150 abuts against the letoff button 156 (in the absence of the early escapement tabs 184). In this configuration, the opposite end 154 of jack 150 abuts the hammer knuckle 166. When the hammer shank 134 impacts against the pad 120 of stop rail assembly 100, the jack's movement will be halted at the point shown in FIG. 10, thereby also halting the upward motion of the left end (as seen in FIG. 10) of whippen 148. This also inhibits the upward motion of the capstan screw 146, thereby further inhibiting the upward motion of the key tail 144. This inhibited motion will be translated into a noticeable difference in the "touch" or "feel" of the key action as discerned by the human performer touching the keys 142. In this configuration, the "feel" of the key action will appear to be much more harsh. The angle B of whippen 148 is less than the angle A of whippen 148 in FIG. 7, thereby showing the difference in the allowable upward positioning of the left end of whippen 148 in the presence of the early escapement tabs 148 (in FIG. 7) and in the absence of these tabs (in FIG. 10). This is an important feature of the "electronic" mode when using stop rail assembly 100, for it allows the human performer to practice relatively silently without sacrificing any playability of the piano keys.

Figure 8:
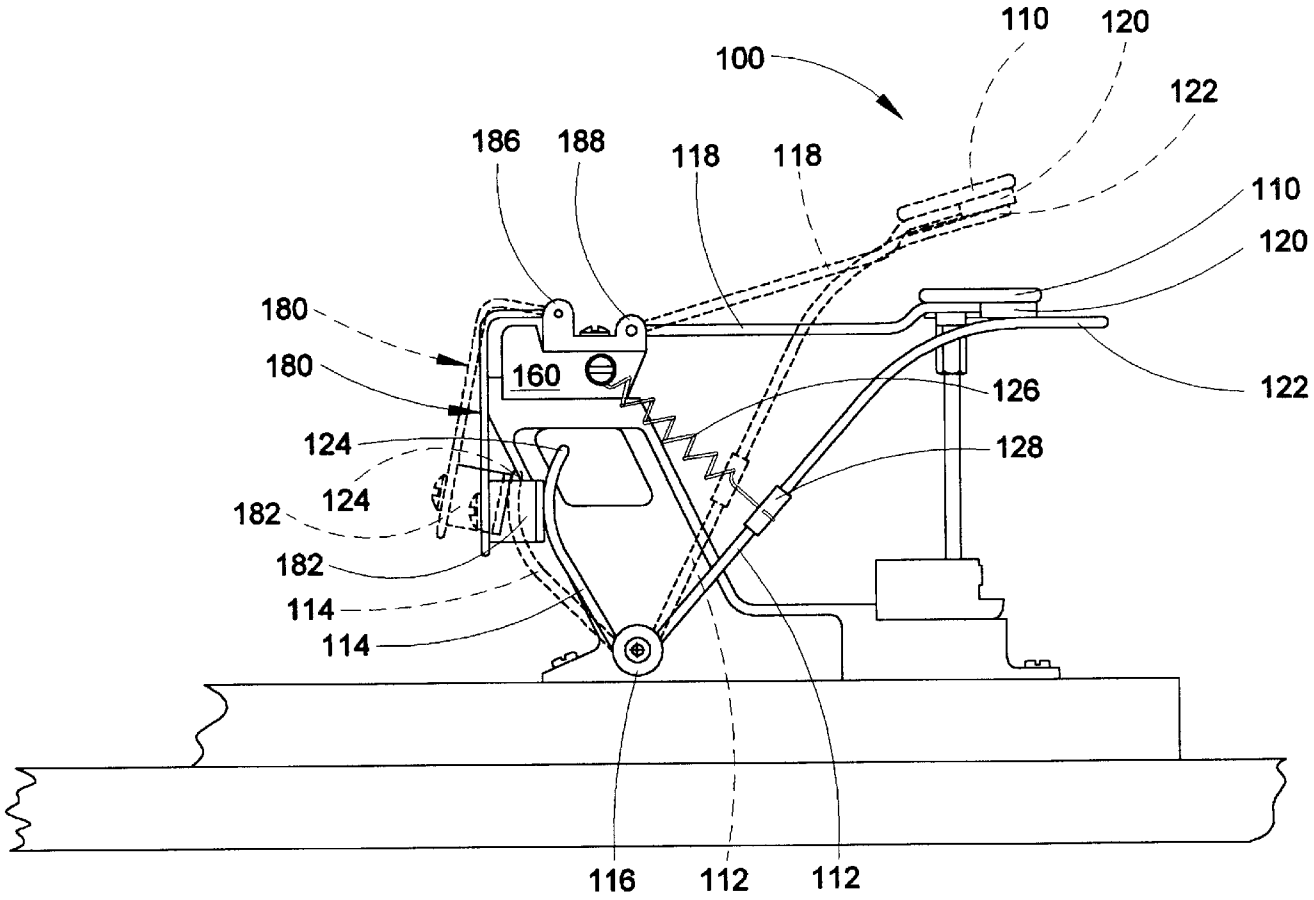
FIG. 8 is a side elevational view in partial cross-section of the grand piano hammer shank stop rail of FIG. 3, depicting the details of the movements of the wire cam, hammer shank stop rail, and "early escapement rail," shown both in their actuated or "electronic mode" position and non-actuated or "acoustic mode" position.

FIG. 8 depicts the various engaged and non-engaged positions in a single illustration of the hammer shank stop rail assembly 100, the wire cam 112 and wire cam 114, and the early escapement rail 180. The solid lines depict the engaged or blocking position, which would be used in the "electronic" mode of piano use. The phantom lines depict these same components in the "free" or non-engaged position, for use in the "acoustic" mode of using the piano.

If the piano contains electronic sensors to detect the motions of the keys 142, then the human performer can "hear" an electronic rendition of the music being played while the piano is in its "electronic" mode. Of course, it would also be possible for the piano to be placed into its "acoustic" mode (where the hammer shank stop rail assembly 100 is in its non-engaged or free position), while at the same time allowing the electronic means of sensing the key movements to generate tones by use of a MIDI interface and sound generator board, thereby creating both electrical signals and acoustic vibrations simultaneously from a single piano.

Figure 9:
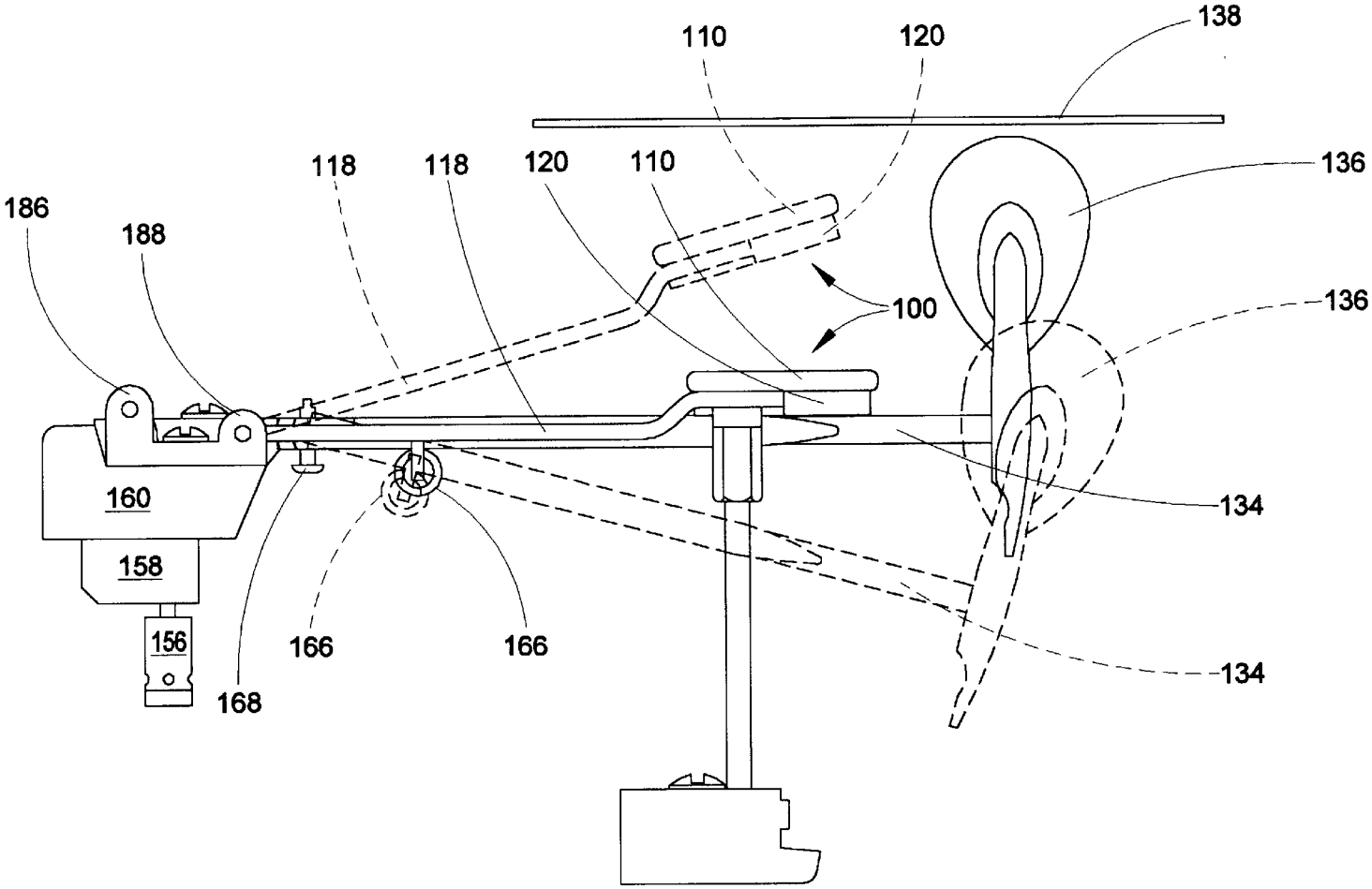
FIG. 9 is a side elevational view of the grand piano hammer shank stop rail of FIG. 3, depicting details of the movements of the hammer shank stop rail and the hammer head, both in the engaged and the non-engaged positions of the hammer shank stop rail.

FIG. 9 shows further details of the movements of the hammer shank stop rail assembly 100, and the hammer shanks 134 and hammer heads 136 on a single illustration. The hammer shank stop rail is shown in solid lines in its engaged or blocking position, and in phantom lines in its non-engaged or free position. The hammer shanks and hammer heads are shown in phantom lines in the non-actuated position, and in solid lines in their actuated but blocked position.

As related above, FIG. 10 depicts a hypothetical arrangement where the hammer shank stop rail assembly 100 has been placed into its blocking or engaged position, and intercepts the hammer shank 134 at a point that prevents the hammer head 136 from striking string 138. In this hypothetical configuration, the early escapement rail 182 has not been moved into its proper engaged position, thereby preventing the early escapement tabs 184 from being interposed between the cam end surface 152 of the jack 150 and the letoff button 156. In this configuration, the "touch" or "feel" of the key action will feel quite harsh to a human player using keys 142. This would be generally undesirable, and this configuration is shown only for illustrative purposes as a comparison to the preferred embodiment shown in FIG. 7.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A hammer shank stop rail mechanism for use in a piano and actuated by a control of the piano, said piano having a keyboard and a key action for each key, including at least one hammer shank, hammer knuckle, letoff button, jack, head and string associated with each of said keys, said hammer shank stop rail mechanism comprising:

(a) an elongated hammer shank stop rail having longitudinal first and second sides terminating in first and second ends, said longitudinal first side facing toward said hammer shanks, said stop rail being pivotably mounted along a longitudinal axis of rotation, said control inducing motion that either raises said stop rail to a first, non-actuated position or lowers said stop rail to a second, actuated position, said stop rail, when in its actuated position, being positioned within the path of travel of said hammer shanks and thereby preventing the corresponding hammer heads from striking their corresponding strings while said first longitudinal side of the stop rail absorbs the impact of said hammer shanks, said stop rail, when in its non-actuated position, being positioned outside the path of travel of said hammer shanks and thereby allowing said hammer heads to strike their corresponding strings; and (b) one or more early escapement tabs which have a non-contacting location and a contacting location which, when in said contacting location, are placed between each of said letoff buttons and an end of its corresponding jack of said key action so as to reposition the letoff event such that the jack escapes from contact from its corresponding hammer knuckle before the corresponding hammer shank comes into contact with said stop rail.

2. The hammer shank stop rail mechanism as recited in claim 1, wherein said stop rail comprises a substantially planar rail made of steel that is partially covered with a sound absorbing material on its longitudinal first side.

3. The hammer shank stop rail mechanism as recited in claim 2, wherein said sound absorbing material comprises felt.

4. The hammer head stop rail mechanism as recited in claim 1, wherein said control comprises a foot pedal.

5. The hammer head stop rail mechanism as recited in claim 1, wherein said control comprises a hand-actuated knob.

6. The hammer shank stop rail mechanism as recited in claim 1, further comprising an electric piano-type keyboard, in addition to said keyboard, which outputs electrical signals during time periods that said piano has its hammer shank stop rail mechanism being actuated by said control.

7. The hammer shank stop rail mechanism as recited in claim 1, further comprising an electric piano-type keyboard, in addition to said keyboard, which outputs electrical signals during time periods that said piano does not have its hammer shank stop rail mechanism being actuated by said control.

8. The hammer shank stop rail mechanism as recited in claim 1, further comprising a pivotable positioning arm having a first end and a second end, said first end being movable and operationally attached to said stop rail, said second end being pivotable at a stationary pivot point.

9. A hammer shank stop rail mechanism for use in a piano and actuated by a control of the piano, said piano having a keyboard and key action for each key, including at least one hammer shank, hammer knuckle, letoff button, jack, head and string associated with each of said keys, said hammer shank stop rail mechanism comprising:

(a) an elongated hammer shank stop rail having longitudinal first and second sides terminating in first and second ends, said longitudinal first side facing toward said hammer shanks, said stop rail being pivotably mounted along a longitudinal axis of rotation, said control inducing motion in said stop rail between a first, non-actuated position and a second, actuated position, said stop rail, when its actuated position, being positioned within the path of travel of said hammer shanks and thereby preventing the corresponding hammer heads from striking their corresponding strings while said first longitudinal side of the stop rail absorbs the impact of said hammer shanks, said stop rail, when in its non-actuated position, being positioned outside the path of travel of said hammer shanks and thereby allowing said hammer heads to strike their corresponding strings; and (b) a pivotable wire cam that positions an early escapement tab either in a non-contacting location when said stop rail is in its non-actuated position, or in a contacting location when said stop rail is in its actuated position, wherein said early escapement tab, when in its contact location, is placed between each of said letoff buttons and an end of its corresponding jack of said key action so as to reposition the letoff event such that the jack escapes from contact with its corresponding hammer knuckle before the corresponding hammer shank comes into contact with said stop rail.

10. The hammer shank stop rail mechanism as recited in claim 9, wherein said stop rail comprises a substantially planar rail made of steel that is partially covered with a sound absorbing material on its longitudinal first side.

11. The hammer shank stop rail mechanism as recited in claim 10, wherein said sound absorbing material comprises felt.

12. The hammer head stop rail mechanism as recited in claim 9, wherein said control comprises a foot pedal.

13. The hammer head stop rail mechanism as recited in claim 9, wherein said control comprises a hand-actuated knob.

14. The hammer shank stop rail mechanism as recited in claim 9, further comprising an electric piano-type keyboard, in addition to said keyboard, which outputs electrical signals during time periods that said piano has its hammer shank stop rail mechanism being actuated by said control.

15. The hammer shank stop rail mechanism as recited in claim 9, further comprising an electric piano-type keyboard, in addition to said keyboard, which outputs electrical signals during time periods that said piano does not have its hammer shank stop rail mechanism being actuated by said control.

16. The hammer shank stop rail mechanism as recited in claim 9, further comprising a pivotable positioning arm having a first end and a second end, said first end being movable and operationally attached to said stop rail, said second end being pivotable at a stationary pivot point.

* * * * *